US006125803A

United States Patent [19]

Hattori et al.

[11] Patent Number: 6,125,803

[45] Date of Patent: Oct. 3, 2000

[54] ELECTROMAGNETICALLY DRIVEN VALVE FOR AN INTERNAL COMBUSTION ENGINE

[75] Inventors: Hiroyuki Hattori; Takashi Izuo; Tatsuo Iida; Masahiko Asano; Yoshinori Kadowaki; Akihiro Yanai, all of Toyota; Toshio Fuwa, Nagoya, all of Japan

[73] Assignee: Toyota Jidosha Kabushiki Kaisha, Toyota, Japan

[21] Appl. No.: 09/108,507

[22] Filed: Jul. 1, 1998

[30] Foreign Application Priority Data

Sep. 22, 1997 [JP] Japan ..... 9-257050
Nov. 7, 1997 [JP] Japan ..... 9-305912

[51] Int. Cl.[7] ..... F01L 9/04

[52] U.S. Cl. ..... 123/90.11; 251/129.1; 251/129.16; 335/262; 335/266

[58] Field of Search ..... 123/90.11; 251/129.01, 251/129.02, 129.1, 129.15, 129.16, 129.19; 335/262, 266

[56] References Cited

U.S. PATENT DOCUMENTS

| | | | |
|---|---|---|---|
| 4,715,332 | 12/1987 | Kreuter | 123/90.11 |
| 4,719,882 | 1/1988 | Kreuter | 123/90.11 |
| 5,131,624 | 7/1992 | Kreuter et al. | 251/129.18 |
| 5,636,601 | 6/1997 | Moriya et al. | 123/90.11 |
| 5,927,237 | 7/1999 | Komatsu et al. | 123/90.11 |
| 5,941,201 | 8/1999 | Shimizu et al. | 123/90.11 |

FOREIGN PATENT DOCUMENTS

| | | |
|---|---|---|
| 793 004 | 9/1997 | European Pat. Off. . |
| 296 20 741 U | 5/1998 | Germany . |
| 3-79528 | 12/1991 | Japan . |
| 4-502048 | 4/1992 | Japan . |
| 7-335437 | 12/1995 | Japan . |
| 2 137 420 | 10/1984 | United Kingdom . |

*Primary Examiner*—Weilun Lo
*Attorney, Agent, or Firm*—Kenyon & Kenyon

[57] ABSTRACT

The present invention relates to an electromagnetically driven valve suited for use in an internal combustion engine and aims at achieving appropriate operating characteristics in accordance with operating conditions of the internal combustion engine at the time of opening or closing a valve body. An armature moving together with the valve body is provided and upper and lower cores are disposed on opposed sides of the armature. The upper core and the lower core accommodate upper and lower coils, respectively. An annular protrusion, formed not on the upper core but on the lower core only, has an inner diameter slightly larger than an outer diameter of the armature.

4 Claims, 11 Drawing Sheets

ELECTROMAGNETICALLY DRIVEN VALVE FOR AN INTERNAL COMBUSTION ENGINE

INCORPORATION BY REFERENCE

The disclosed contents of Japanese Patent Applications Nos. HEI 9-257050 filed on Sep. 22, 1997 and HEI 9-305912 filed on Nov. 7, 1997, each including the specification, drawings and abstract are incorporated herein by reference in their entirety.

FIELD OF THE INVENTION

The present invention relates to an electromagnetically driven valve for an internal combustion engine and, more particularly, relates to an electromagnetically driven valve suited for use as an intake valve or an exhaust valve of an internal combustion engine.

BACKGROUND OF THE INVENTION

An electromagnetically driven valve employed as an intake valve or an exhaust valve of an internal combustion engine is disclosed, for instance, in Japanese Patent Official Publication No. HEI 4-502048 and Japanese Patent Application Laid-Open No. HEI 7-335437. This electromagnetically driven valve is provided with an armature attached to a valve body. An upper spring and a lower spring are disposed above and below the armature respectively. These springs urge the armature toward its neutral position.

An upper core and a lower core are disposed above and below the armature respectively and an upper coil and a lower coil are disposed within the upper core and the lower core respectively. The upper coil and the lower coil, if supplied with an exciting current, generate a magnetic flux circulating therethrough. Upon generation of such a magnetic flux, the armature is attracted toward the upper core or the lower core by an electromagnetic force (hereinafter referred to as an attracting force). Thus, the aforementioned electromagnetically driven valve can displace the valve body to its closed position or its open position by supplying a predetermined exciting current to the upper coil or the lower coil.

If supply of an exciting current to the upper coil or the lower coil is stopped after displacement of the valve body to its closed position or its open position, the armature and the valve body are urged by the springs to start a simple harmonic motion. Unless the amplitude of the simple harmonic motion is damped, the armature and the valve body that move from one displacement end toward the other displacement end (hereinafter referred to as a desired displacement end) reach the desired displacement end solely due to urging forces of the springs. However, such displacement of the armature and the valve body causes energy loss resulting from sliding friction or the like. Therefore, the critical position that can be reached by the armature and the valve body due to the urging forces of the springs is not coincident with the desired displacement end.

The aforementioned electromagnetically driven valve can compensate for the amount of energy loss resulting from sliding movement and displace the armature and the valve body to the desired displacement end by starting to supply an exciting current to one of the upper coil and the lower coil at a suitable timing after stoppage of supply of an exciting current to the other of the upper coil and the lower coil. The valve body can thereafter be opened and closed by alternately supplying an exciting current to the upper coil and the lower coil at suitable timings.

In the aforementioned electromagnetically driven valve, each of the upper core and the lower core is provided with an annular protrusion disposed along an outer periphery thereof. The annular protrusion, which has a predetermined length, protrudes from an end face of the upper core or the lower core. The inner diameter of the annular protrusion is slightly larger than the outer diameter of the armature.

When the armature is spaced apart from the desired displacement end, the attracting force acting on the armature (hereinafter referred to as a spaced-state attracting force) is larger in the case where the annular protrusion is provided than in the case where the annular protrusion is not provided. On the other hand, when the armature is close to the desired displacement end, the attracting force acting on the armature (hereinafter referred to as a close-state attracting force) is smaller in the case where the annular protrusion is provided than in the case where the annular protrusion is not provided. Accordingly, as the armature approaches the desired displacement end, the aforementioned electromagnetically driven valve can gradually increase an attracting force acting on the armature.

The armature collides with the upper core or the lower core upon arrival of the valve body at its open position or its closed position, thus causing impact noise. In order to reduce impact noise, it is desired to prevent the attracting force acting on the armature from becoming unsuitably large upon arrival of the armature at the desired displacement end.

In order to reliably displace the armature to the desired displacement end, it is necessary to ensure a spaced-state attracting force of a certain magnitude. In order to ensure a large spaced-state attracting force and reduce impact noise in the electromagnetically driven valve, it is advantageous to avoid an abrupt increase in the attracting force acting on the armature as the armature approaches the desired displacement end. The aforementioned electromagnetically driven valve can satisfy the aforementioned advantageous condition during both the valve opening operation and the valve closing operation. As a result, the aforementioned electromagnetically driven valve can achieve an enhanced tranquility.

In the aforementioned electromagnetically driven valve, the neutral position of the armature is set to the central position between an electromagnet on the valve opening side and an electromagnet on the valve closing side. Thus, there is no change in the amount of energy stored in a pair of springs regardless of whether the armature is positioned on the electromagnet on the valve closing side or on the electromagnet on the valve opening side. In this case, there is no substantial change in the amount of energy required for the springs to urge the armature regardless of whether the valve moves in the valve opening direction or in the valve closing direction.

However, the load applied to the valve body in the internal combustion engine may differ depending on whether the valve body moves in the valve opening direction or in the valve closing direction. Hence, a difference in the amount of energy loss may arise depending on whether the valve body of the electromagnetically driven valve moves in the valve opening direction or in the valve closing direction.

For example, the exhaust valve is opened when a high combustion pressure remains in a combustion chamber and it is closed when the combustion pressure is released. In this case, the load applied to the exhaust valve is larger during the valve opening operation than during the valve closing operation.

Preferably, there should be no substantial difference between the exciting current to be supplied to the electromagnet on the valve opening side and the exciting current to be supplied to the electromagnet on the valve closing side.

The aforementioned electromagnetically driven valve is unable to achieve appropriate operating characteristics during the valve opening operation and during the valve closing operation while substantially supplying an equal exciting current to the electromagnets on the valve opening side and on the valve closing side.

SUMMARY OF THE INVENTION

The present invention has been made in view of the aforementioned background and it is an object of the present invention to provide an electromagnetically driven valve that achieves appropriate operating characteristics in accordance with operating conditions of an internal combustion engine at the time of opening or closing a valve body.

Further, it is another object of the present invention to provide an electromagnetically driven valve that achieves substantially the same operating characteristics regardless of whether the valve body moves in the valve opening direction or in the valve closing direction when a pair of electromagnets are substantially supplied with an equal exciting current.

In order to achieve the aforementioned objects, a first aspect of the present invention provides an electromagnetically driven valve for an internal combustion engine including an armature coupled to a valve body for reciprocal movement therewith between a first position and a second position, a first electromagnet, a second electromagnet, a first elastic member, and a second elastic member. The first electromagnet is disposed on a first side of the armature adjacent to the first position and the second electromagnet is disposed on a second side of the armature adjacent to the second position. First and second elastic members are coupled to the armature. The first elastic member is biased to urge the armature in a first direction toward the first position and the second elastic member is biased to urge the armature in a second direction opposite the first direction toward the second position. When no electromagnetic force is applied to the armature by the first and second electromagnets, the armature resides in a neutral position between the first and second positions. The neutral position is closer to the first electromagnet than the second electromagnet.

A second aspect of the present invention provides an electromagnetically driven valve for an internal combustion engine including an armature coupled to a valve body for reciprocal movement therewith between a first position and a second position, a first elastic member, a second elastic member, a first core, and a second core. The first elastic member is coupled to the armature to bias the armature toward the first position and the second elastic member is coupled to the armature to bias the armature toward the second position. A neutral position of the armature is defined between the first and second positions at the point where the forces applied from the first and second elastic member balance one another. The first core includes a first coil therein and the second core includes a second coil therein. The first and second cores are disposed on opposite sides of the armature and are positioned so that, when the armature is in the neutral position, the first and second cores are spaced apart from the armature. One of the first core and the armature is provided with a first protrusion protruding a predetermined length toward the other of the first core and the armature thereby making a distance between the first core and the armature smaller than a distance between the second core and the armature when the armature is located in the neutral position. The other of the first core and the armature is provided with a protrusion facing side that faces a side of the first protrusion when said armature is in the first position.

A third aspect of the present invention provides an electromagnetically driven valve for an internal combustion engine including an armature coupled to a valve body for reciprocal movement therewith between a first position and a second position, a first elastic member, a second elastic member, a first electromagnet, and a second electromagnet. The first elastic member is coupled to the armature to bias the armature toward the first position and the second elastic member is coupled to the armature to bias the armature toward the second position. A neutral position of the armature is defined between the first and second positions at a point in which the forces applied from the first and second elastic member balance one another. The first electromagnet is adjacent to the first position and the second electromagnet is adjacent to the second position. The first and second electromagnets are positioned so that, when the armature is in the neutral position. The first and second electromagnets are spaced apart from the armature. The neutral position is closer to the first electromagnet than the second electromagnet.

According to the first aspect of the present invention, whether the valve body is driven in the valve opening direction or in the valve closing direction, the armature can suitably displace the valve body regardless of a difference in load applied thereto or a difference in amplitude of a damping factor thereof.

According to the second aspect of the present invention, when the armature is close to the first core, a side of the protrusion disposed on the first core or on the armature faces a protrusion facing side corresponding to the protrusion. In this construction, as the armature approaches the first core, a large spaced-state attracting force acting on the armature tends to increase gradually. As the armature approaches the second core, a relatively small spaced-state attracting force acting on the armature tends to increase abruptly. According to the characteristics of this aspect, in the case where a large load is applied to the valve body when the armature approaches the first core and no large load is applied to the valve body when the armature approaches the second core, the valve body can be suitably operated with a low electric power consumption.

According to the third aspect of the present invention, the elastic members generate an urging force that urges the valve body toward its neutral position between first and second electromagnets. The neutral position of the valve body is biased toward the first electromagnet. Hence, more energy is stored in the elastic members when the armature is attracted to the second electromagnet than when the armature is attracted to the first electromagnet. Thus, the elastic members urge the armature away from the second electromagnet with high energy and urge the armature away from the first electromagnet with low energy. In this case, whether the armature moves in the valve opening direction or in the valve closing direction, the armature exhibits substantially the same operating characteristics regardless of a difference in an amplitude of a damping amount.

BRIEF DESCRIPTION OF THE DRAWINGS

Further objects, features and advantages of the present invention will become apparent from the following description of preferred embodiments with reference to the accompanying drawings, wherein.

DESCRIPTION OF PREFERRED EMBODIMENTS

Figure 1:
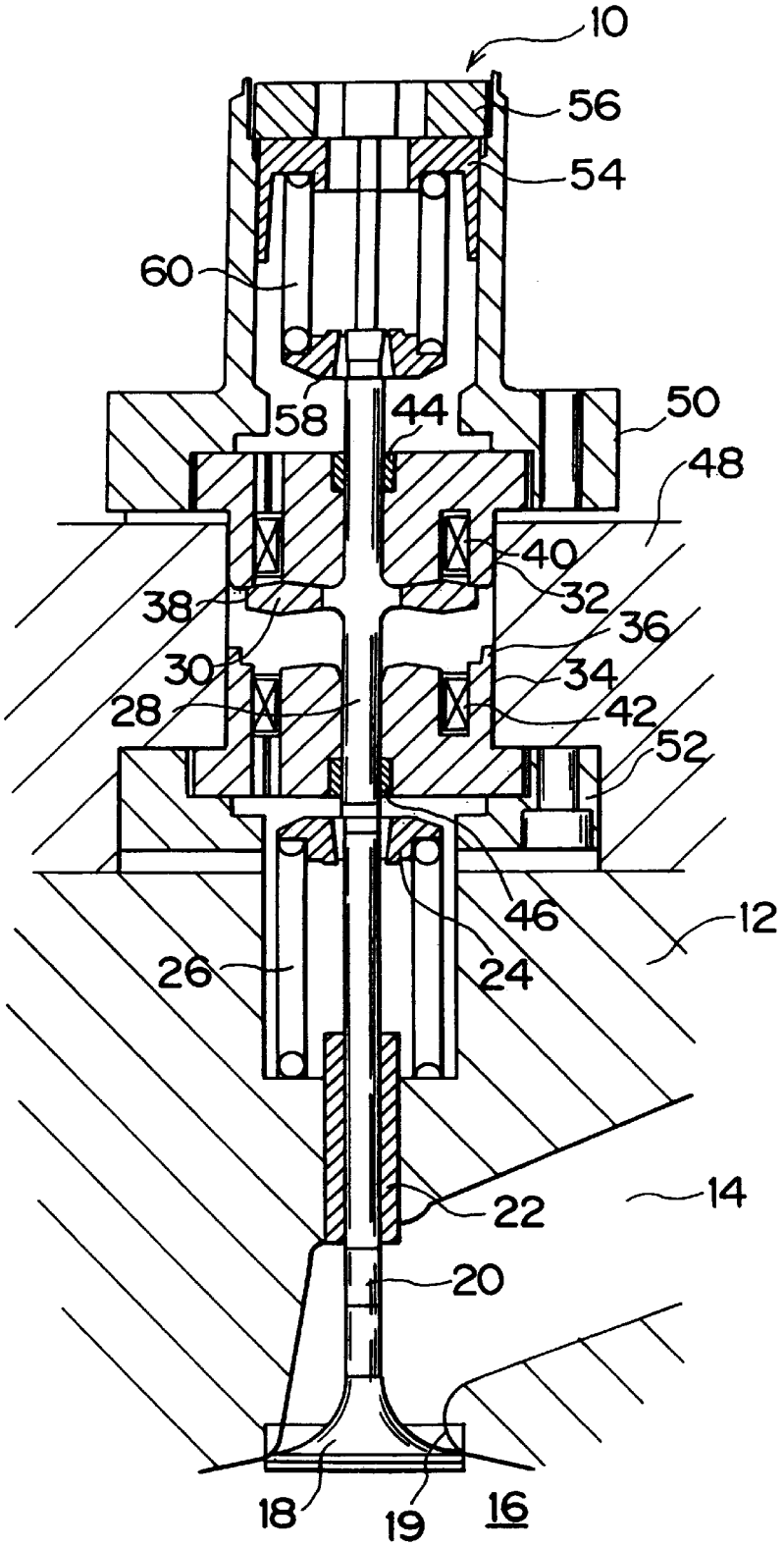
FIG. 1 is a sectional view of an electromagnetically driven valve according to a first embodiment of the present invention.

FIG. 1 is a sectional view of an electromagnetically driven valve 10 according to a first embodiment of the present invention. The electromagnetically driven valve 10 is employed as an exhaust valve for an internal combustion engine. The electromagnetically driven valve 10 is attached to a cylinder head 12 in which an exhaust port 14 is formed. Formed in a lower portion of the cylinder head 12 is a combustion chamber 16. The electromagnetically driven valve 10 is provided with a valve body 18 for bringing the exhaust port 14 into or out of communication with the combustion chamber 16. A valve seat 19 onto which the valve body moves is disposed in the exhaust port 14. The exhaust port 14 is brought into communication with the combustion chamber 16 when the valve body 18 moves away from the valve seat 19, while the exhaust port 14 is brought out of communication with the combustion chamber 16 when the valve body 18 moves onto the valve seat 19.

A valve shaft 20 is formed integrally with the valve body 18. A valve guide 22 is disposed inside the cylinder head 12. The valve shaft 20 is slidably held by the valve guide 22. A lower retainer 24 is attached to an upper end portion of the valve shaft 20. A lower spring 26 is disposed beneath the lower retainer 24. The lower spring 26 urges the lower retainer 24 upwards in FIG. 1.

The upper end portion of the valve shaft 20 abuts against an armature shaft 28 made of a non-magnetic material. An armature 30, which is an annular member made of a magnetic material, is attached to the armature shaft 28.

Upper core 32 and a lower core 34, each being annular members made of a magnetic material, are disposed above and below the armature 30 respectively. The lower core 34 has an annular protrusion 36, which has a predetermined length and protrudes from a surface of the lower core 34 toward the upper core 32. The electromagnetically driven valve 10 according to this embodiment is characterized in that the annular protrusion 36 is formed not on the upper core 32 but only on the lower core 34.

The annular protrusion 36 has a diameter slightly larger than an outer diameter of the armature 30. Thus, when the armature 30 approaches sufficiently close to the lower core 34, an inner wall of the annular protrusion 36 faces an outer peripheral surface of the armature 30. The outer peripheral surface of the armature 30, which faces the inner peripheral surface of the annular protrusion 36, will hereinafter be referred to as a protrusion facing side 38.

The upper core 32 and the lower core 34 accommodate an upper coil 40 and a lower coil 42 respectively. Bearings 44, 46 are disposed in the vicinity of central axes of the upper core 32 and the lower core 34 respectively. The armature shaft 28 is slidably held by the bearings 44, 46.

A core guide 48 surrounds outer peripheral surfaces of the upper core 32 and the lower core 34. The core guide 48 suitably adjusts a location of the upper core 32 relative to the lower core 34. An upper case 50 is attached to an upper portion of the upper core 32, while a lower case 52 is attached to a lower portion of the lower core 34.

A spring guide 54 and an adjuster bolt 56 are disposed in an upper end portion of the upper case 50. An upper retainer 58 connected with an upper end of the armature shaft 28 is disposed below the spring guide 54. Disposed between the spring guide 54 and the upper retainer 58 is an upper spring 60 which urges the upper retainer 58 and the armature shaft 28 downwards in FIG. 1. The adjuster bolt 56 adjusts a neutral position of the armature 30. In this embodiment, the neutral position of the armature 30 is adjusted to a central portion of a space defined by the upper core 32 and the lower core 34.

The operation of the electromagnetically driven valve 10 will hereinafter be described with reference to FIGS. 2 through 9 as well as FIG. 1.

In the electromagnetically driven valve 10, when no exciting current is supplied to the upper coil 40 or the lower coil 42, the armature 30 assumes its neutral position. That is, the armature 30 is held in a central portion of the space defined by the upper core 32 and the lower core 34. When an exciting current is supplied to the upper coil 40 with the armature 30 assuming its neutral position, an electromagnetic force attracting the armature 30 toward the upper core 32 is generated in a space defined by the armature 30 and the upper core 32. Hence, the electromagnetically driven valve 10 can displace the armature 30 toward the upper core 32 by supplying a suitable exciting current to the upper coil 40. The valve body 18 moves onto the valve seat 19 to be completely closed prior to abutment of the armature 30 on the upper core 32. Thus, the electromagnetically driven valve 10 can completely close the valve body 18 by supplying a suitable exciting current to the upper coil 40.

If supply of an exciting current to the upper coil 40 is stopped with the valve body 18 completely closed, the valve body 18, the valve shaft 20, the armature shaft 28 and the armature 30 start to move downwards in FIG. 1 due to urging forces of the upper spring 60 and the lower spring 26.

Displacement of the valve body 18 causes energy loss resulting from sliding friction and the like. The electromagnetically driven valve 10 can compensate for such energy loss by supplying an exciting current to the lower coil 42 to displace the valve body 18 until the armature 30 abuts against the lower core 34. The valve body 18 becomes completely open when the armature 30 abuts against the lower core 34.

Consequently, the electromagnetically driven valve 10 can completely open the valve body 18 by starting to supply an exciting current to the lower coil 42 at a suitable time after stoppage of the supply of the exciting current to the upper coil 40. The electromagnetically driven valve 10 can suitably open or close the valve body 18 by supplying at a suitable time thereafter a suitable exciting current to the upper coil 40 or the lower coil 42.

The electromagnetically driven valve 10 according to this embodiment is characterized in that the annular protrusion 36 is formed not on the upper core 32 but only on the lower core 34. The effect achieved by this feature will be described hereinafter.

Figure 2:
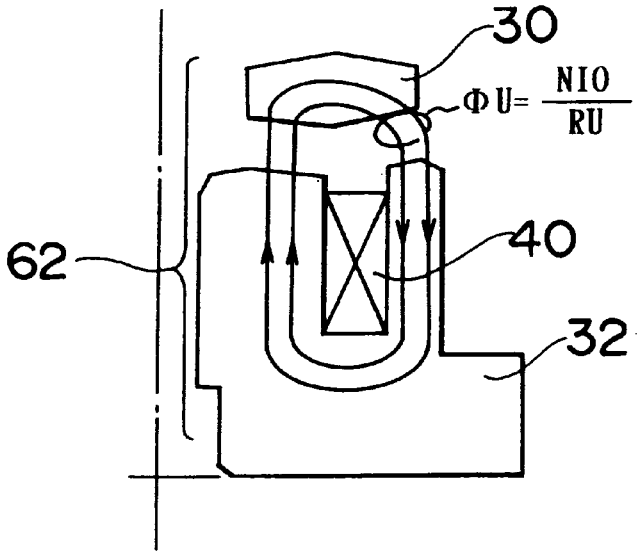
FIG. 2 illustrates flow of a magnetic flux U circulating round an upper coil in the electromagnetically driven valve as illustrated in FIG. 1 when an armature is spaced apart from the upper core.

FIG. 2 illustrates flow of a magnetic flux U circulating through the upper core 32 and the armature 30 when a predetermined current $I_0$ is supplied to the upper coil 40. The flow of the magnetic flux U as illustrated in FIG. 2 is realized when the armature 30 is spaced far apart from the upper core 32. Provided that N represents the number of turns of the upper coil 40 and $R_U$ represents a reluctance of a magnetic circuit including the upper core 32 and the armature 30 (hereinafter referred to as an upper magnetic circuit 62), the magnetic flux U circulating through the upper magnetic circuit 62 is expressed as follows.

$$U=(N\ I_0)/R_U \tag{1}$$

Figure 3:
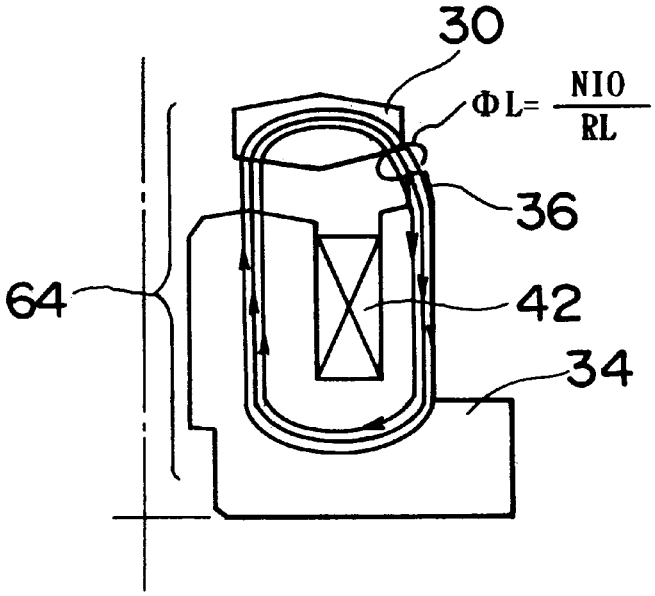
FIG. 3 illustrates flow of a magnetic flux L circulating round a lower coil in the electromagnetically driven valve as illustrated in FIG. 1 when the armature is spaced apart from the lower core.

FIG. 3 illustrates flow of a magnetic flux L circulating through the lower core 34 and the armature 30 when a predetermined current $I_0$ is supplied to the lower coil 42. The flow of the magnetic flux L as illustrated in FIG. 3 is realized when the armature 30 is spaced far apart from the lower core 34. Provided that N represents the number of turns of the lower coil 42 and $R_L$ represents a reluctance of a magnetic circuit including the lower core 34 and the armature 30 (hereinafter referred to as a lower magnetic circuit 64), the magnetic flux L circulating through the lower magnetic circuit 64 is expressed as follows.

$$L=(N\ I_0)/R_L \tag{2}$$

The smaller an air gap formed between the upper core 32 and the armature 30 becomes, the smaller the reluctance $R_U$ of the upper magnetic circuit 62 becomes. Likewise, the smaller an air gap formed between the lower core 34 and the armature 30 becomes, the smaller the reluctance $R_L$ of the lower magnetic circuit 64 becomes.

In this embodiment, the annular protrusion 36 protruding toward the armature 30 is formed on the lower core 34. When the armature 30 is spaced apart from the lower core 34, the annular protrusion 36 serves to reduce the air gap formed therebetween. Hence, if the armature 30 is equally distant from the upper core 32 and the lower core 34, the reluctance $R_L$ of the lower magnetic circuit 64 is smaller than the reluctance $R_U$ of the upper magnetic circuit 62. Accordingly, in this case, the amount of magnetic flux L flowing through the lower magnetic circuit 64 is larger than the amount of magnetic flux U flowing through the upper magnetic circuit 62.

In the electromagnetically driven valve 10, when the magnetic flux U flows through the upper magnetic circuit 62, an attracting force is generated between the armature 30 and the upper core 32 to reduce the air gap formed in the upper magnetic circuit 62. On the other hand, when the magnetic flux L flows through the lower magnetic circuit 64, an attracting force is generated between the armature 30 and the lower core 34 to reduce the air gap formed in the lower magnetic circuit 64.

If the armature 30 is spaced far apart from the upper core 32, the aforementioned attracting force mainly serves to attract the armature 30 toward the upper core 32. If the armature 30 is spaced far apart from the lower core 34, the aforementioned attracting force mainly serves to attract the armature 30 toward the lower core 34. The larger the amount of magnetic flux flowing through the air gap to be reduced becomes, the larger the aforementioned attracting force becomes.

Thus, when the armature 30 is equally distant from the upper core 32 and the lower core 34 and an exciting current $I_0$ is supplied to both the upper coil 40 and the lower coil 42, the attracting force generated between the armature 30 and the lower core 34 is larger than the attracting force generated between the armature 30 and the upper core 32. When the armature 30 is spaced far apart from the upper core 32 or the lower core 34, an attracting force generated therebetween will hereinafter be referred to as a spaced-state attracting force $F_F$.

Figure 4:
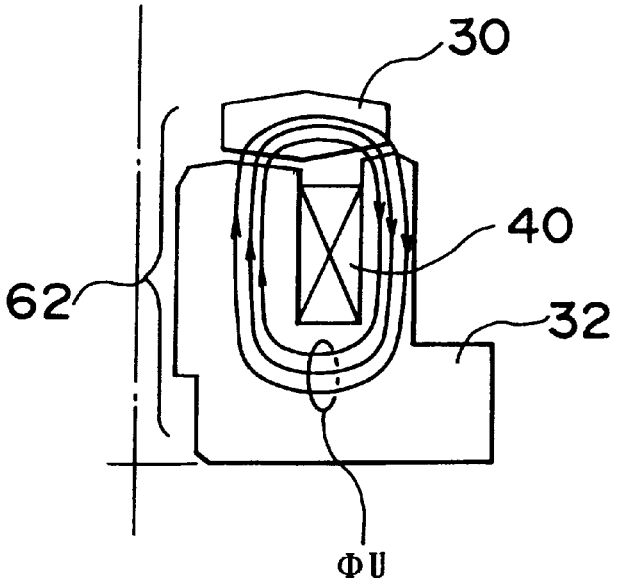
FIG. 4 illustrates flow of a magnetic flux U circulating round the upper coil in the electromagnetically driven valve as illustrated in FIG. 1 when the armature is close to the upper core.

FIG. 4 illustrates flow of a magnetic flux U circulating through the upper core 32 and the armature 30 when a predetermined current $I_0$ is supplied to the upper coil 40. The flow of the magnetic flux U as illustrated in FIG. 4 is realized when the armature 30 is spaced slightly apart from the upper core 32.

The smaller the air gap formed between the armature 30 and the upper core 32 becomes, the smaller the reluctance $R_U$ of the upper magnetic circuit 62 becomes. As can be seen from the aforementioned formula (1), the smaller the reluctance $R_U$ becomes, the larger the amount of magnetic flux U flowing through the upper magnetic circuit 62 becomes. Hence, the amount of magnetic flux U flowing through the upper magnetic circuit 62 is larger when the armature 30 is close to the upper core 32 as illustrated in FIG. 4 than when the armature 30 is spaced far apart from the upper core 32 as illustrated in FIG. 2.

The magnetic flux U, which is transferred between the armature 30 and the upper core 32, mainly serves as an attracting force that attracts the armature 30 toward the upper core 32 even when the armature 30 is spaced slightly apart from the upper core 32. Hence, as the armature 30 approaches the upper core 32, the attracting force that attracts the armature 30 toward the upper core 32 increases in proportion with the magnetic flux U flowing through the upper magnetic circuit 62. When the armature 30 is close to the upper core 32, an attracting force that attracts the armature 30 toward the upper core 32 will hereinafter be referred to as a close-state attracting force $F_N$.

Figure 5:
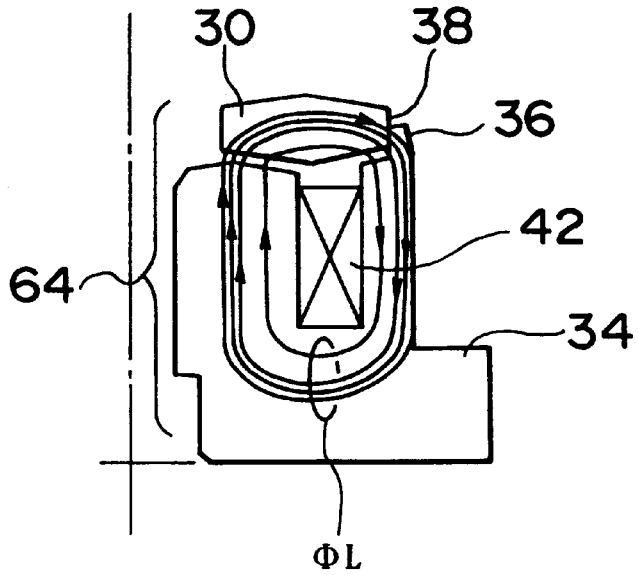
FIG. 5 illustrates flow of a magnetic flux L circulating round the lower coil in the electromagnetically driven valve as illustrated in FIG. 1 when the armature is close to the lower core.

FIG. 5 illustrates flow of a magnetic flux L circulating through the lower core 34 and the armature 30 when a predetermined current $I_0$ is supplied to the lower coil 42. The flow of the magnetic flux L as illustrated in FIG. 5 is realized when the armature 30 is spaced slightly apart from the lower core 34.

The smaller the air gap formed between the armature 30 and the lower core 34 becomes, the smaller the reluctance $R_L$ of the lower magnetic circuit 64 becomes. As can be seen from the aforementioned formula (2), the smaller the reluctance $R_L$ becomes, the larger the amount of magnetic flux L flowing through the lower magnetic circuit 64 becomes. Hence, the amount of magnetic flux L flowing through the lower magnetic circuit 64 is larger when the armature 30 is close to the lower core 34 as illustrated in FIG. 5 than when the armature 30 is spaced far apart from the lower core 34 as illustrated in FIG. 3.

A magnetic flux is transferred between the armature 30 and the lower core 34 via an air gap formed between the protrusion facing side 38 of the armature 30 and the annular protrusion 36 of the lower core 34 (hereinafter referred to as a radial air gap) as well as an air gap formed between a bottom face of the armature 30 and an upper face of the lower core 34 (hereinafter referred to as an axial air gap).

The magnetic flux transferred via the axial air gap serves as an attracting force that always attracts the armature 30 toward the lower core 34. On the other hand, as illustrated in FIG. 5, when the armature 30 is close to the lower core 34 to such an extent that the protrusion facing side 38 faces the inner wall of the annular protrusion 36, the magnetic flux transferred via the radial air gap acts on the armature 30 in the radial direction such that the armature 30 is not urged toward the lower core 34. Therefore, when the armature 30 is close to the lower core 34, the larger the magnetic flux flowing through the axial air gap becomes, the larger the attracting force (the close-state attracting force $F_N$) that attracts the armature 30 toward the lower core 34 becomes.

As the armature 30 approaches the lower core 34, the axial air gap decreases in proportion with a displacement amount of the armature 30 and reaches its minimum value of "0" upon abutment of the armature 30 on the lower core 34. On the other hand, as the armature 30 approaches the lower core 34, the radial air gap reaches its minimum value $G_{MIN}$ upon arrival of a lower end portion of the protrusion facing side 38 on an upper end portion of the annular protrusion 36. Accordingly, the radial air gap is smaller than the axial air gap until the axial air gap becomes smaller than $G_{MIN}$ after arrival of the lower end portion of the protrusion facing side 38 on the upper end portion of the annular protrusion 36.

The magnetic flux L flowing through the lower magnetic circuit 64 tends to follow a route having a small reluctance. Thus, when the radial air gap is smaller than the axial air gap, as the armature 30 approaches the lower core 34, the magnetic flux L flowing through the lower magnetic circuit 64 passes in large part through the radial air gap. In this case, the close-state attracting force $F_N$ assumes a relatively small value for the magnetic flux L. Further, as the armature 30 approaches the lower core 34, the close-state attracting force $F_N$ undergoes relatively gradual changes.

Consequently, the electromagnetically driven valve 10 ensures that the close-state attracting force $F_N$ generated between the armature 30 and the lower core 34 (hereinafter referred to as a lower close-state attracting force) is smaller than the close-state attracting force $F_N$ generated between the armature 30 and the upper core 32 (hereinafter referred to as an upper close-state attracting force). In addition, the lower close-state attracting force generated as the armature 30 approaches the lower core 34 changes more gradually than the upper close-state attracting force generated as the armature 30 approaches the upper core 32.

Figure 6:
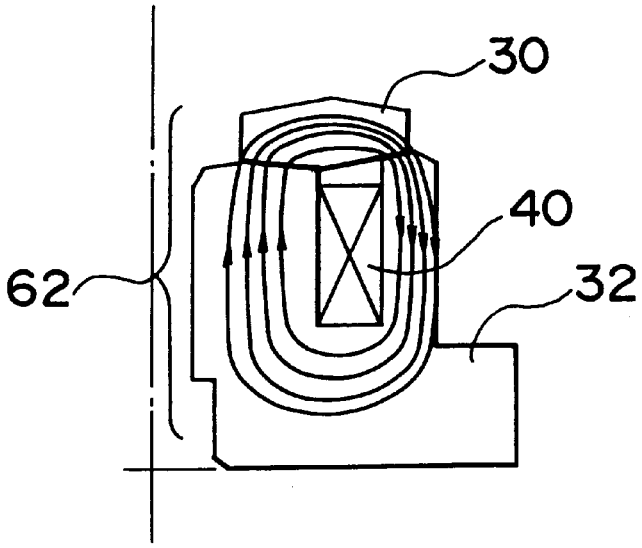
FIG. 6 illustrates flow of a magnetic flux U circulating round the upper coil in the electromagnetically driven valve as illustrated in FIG. 1 when the armature abuts the upper core.

FIG. 6 illustrates flow of a magnetic flux U circulating through the upper core 32 and the armature 30 when a predetermined current $I_0$ is supplied to the upper coil 40. The flow of the magnetic flux U as illustrated in FIG. 6 is realized when the armature 30 abuts against the upper core 32.

The reluctance $R_U$ of the upper magnetic circuit 62 assumes its minimum value when the armature 30 abuts against the upper core 32. In this case, given an exciting current $I_0$, the maximum magnetic flux UMAX flows through the upper magnetic circuit 62 and the maximum attracting force is generated between the armature 30 and the upper core 32. This attracting force will hereinafter be referred to as an abutment-state attracting force $F_C$.

Figure 7:
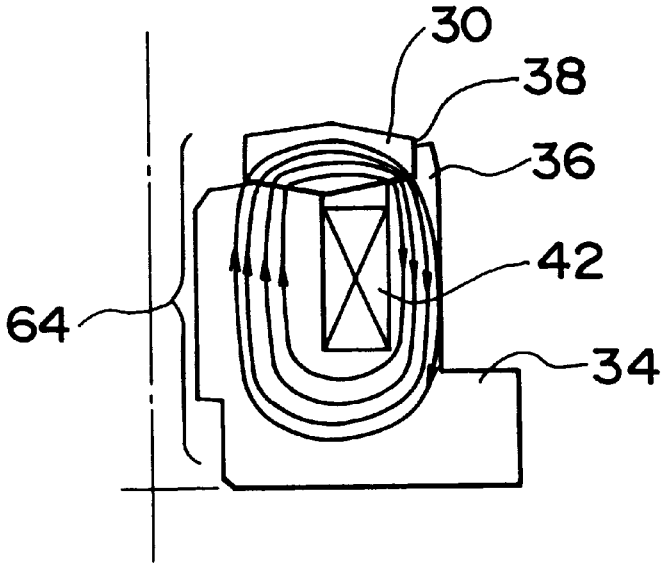
FIG. 7 illustrates flow of a magnetic flux L circulating round the lower coil in the electromagnetically driven valve as illustrated in FIG. 1 when the armature abuts the lower core.

FIG. 7 illustrates flow of a magnetic flux L circulating through the lower core 34 and the armature 30 when a predetermined current $I_0$ is supplied to the lower coil 42. The flow of the magnetic flux L as illustrated in FIG. 7 is realized when the armature 30 abuts against the lower core 34.

The reluctance $R_L$ of the lower magnetic circuit 64 assumes its minimum value when the armature 30 abuts against the lower core 34. In this case, given an exciting current $I_0$, the maximum magnetic flux LMAX flows through the lower magnetic circuit 64. In this embodiment, the air gap formed between the protrusion facing side 38 of the armature 30 and the annular protrusion 36 of the lower core 34 always exceeds the minimum value $G_{MIN}$. Thus, when the armature 30 abuts against the lower core 34, almost all of the magnetic flux L is transferred between the bottom face of the armature 30 and the upper face of the lower core 34. In this case, given an exciting current $I_0$, an abutment-state attracting force $F_C$ is generated between the armature 30 and the lower core 34. This abutment-state attracting force $F_C$ is substantially equal to the abutment-state attracting force $F_C$ generated between the armature 30 and the upper core 32.

Figure 8:
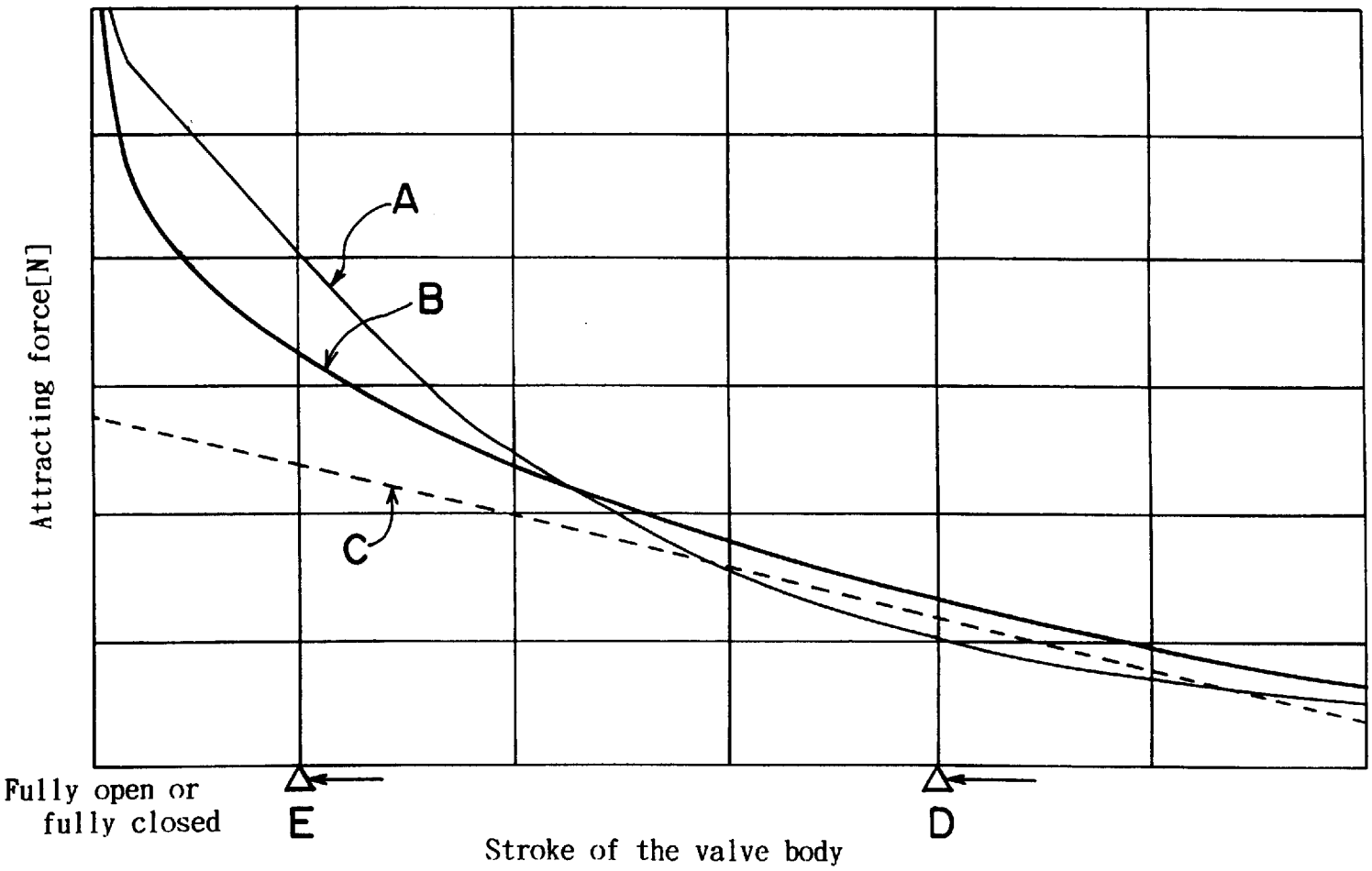
FIG. 8 illustrates operating characteristics of the electromagnetically driven valve as illustrated in FIG. 1.

FIG. 8 illustrates characteristics of the electromagnetically driven valve 10 in accordance with changes in stroke of the valve body 18. Referring to FIG. 8, a curve A indicates an attracting force generated between the armature 30 and the upper core 32 when the valve body 18 is displaced between its neutral position and its fully closed position with an exciting current $I_0$ supplied to the upper coil 40. Further, a curve B indicates an attracting force generated between the armature 30 and the lower core 34 when the valve body 18 is displaced between its neutral position and its fully closed position with the exciting current $I_0$ supplied to the lower coil 42. Still further, a curve C indicates a spring force generated by the upper spring 60 and the lower spring 26 when the valve body 18 is displaced between its neutral position and its fully open position or between its neutral position and its fully closed position.

As described above, an exciting current $I_0$ is supplied to both the upper coil 40 and the lower coil 42, the spaced-state attracting force $F_F$ is larger between the armature 30 and the lower core 34 than between the armature 30 and the upper core 32. In this case, the close-state attracting force $F_N$ is smaller between the armature 30 and the lower core 34 than between the armature 30 and the upper core 32. Further, the abutment-state attracting force $F_C$ generated between the armature 30 and the upper core 32 is substantially equal to the abutment-state attracting force $F_C$ generated between the armature 30 and the lower core 34.

Hence, as the curve A indicates, the attracting force generated between the armature 30 and the upper core 32 is relatively small when the valve body 18 is located in the vicinity of its neutral position. This attracting force tends to increase relatively steeply as the valve body 18 approaches its fully open position. On the other hand, as the curve B indicates, the attracting force generated between the armature 30 and the lower core 34 is relatively large when the valve body 18 is located in the vicinity of its neutral position. This attracting force tends to increase relatively gradually as the valve body 18 approaches its fully open position.

As described already, the electromagnetically driven valve 10 is used as an exhaust valve for an internal combustion engine. Hence, the electromagnetically driven valve 10 operates to open the valve body 18 when a high combustion pressure remains in the combustion chamber 16 and close the valve body 18 after release of the combustion pressure. If the valve body 18 is displaced toward its fully open position when a high combustion pressure remains in the combustion chamber 16, a large load is applied to the valve body 18. On the other hand, when the valve body 18 is thereafter displaced toward its fully closed position, such a large load is not applied to the valve body.

The electromagnetically driven valve 10 is constructed such that the valve body 18, when in its fully closed position after stoppage of supply of an exciting current to the upper coil 40, is displaced toward its fully open position by urging forces of the upper spring 60 and the lower spring 26. Likewise, the electromagnetically driven valve 10 is constructed such that the valve body 18, when in its fully open position after stoppage of supply of an exciting current to the lower coil, is displaced toward its fully closed position by urging forces of the upper spring 60 and the lower spring 26.

FIG. 8, a critical position that can be reached by the valve body 18 due to urging forces of the upper spring 60 and the lower spring 26 during the valve opening operation of the valve body 18 is marked as D. A critical position that can be reached by the valve body 18 due to urging forces of the upper spring 60 and the lower spring 26 during the valve closing operation of the valve body 18 is marked as E. As described above, the valve body 18 is subjected to a larger load during the valve opening operation than during the valve closing operation. Thus, the critical position D is closer to the neutral position of the valve body 18 than is the critical position E.

In order to suitably displace the valve body 18 to its fully open position, when the valve body 18 is located at the critical position D, it is necessary to generate an attracting force that exceeds spring forces generated by the upper spring 60 and the lower spring 26 (the spring forces that urge the valve body 18 toward its neutral position). As the curve B and the straight line C in FIG. 8 indicate, the electromagnetically driven valve 10 satisfies the aforementioned requirement. Hence, the electromagnetically driven valve 10 can suitably displace the valve body 18 to its fully open position.

When the valve body 18 is displaced toward the upper core 32 by a distance corresponding to the critical position D, the attracting force generated between the armature 30 and the upper core 32 is smaller than the spring forces generated by the upper spring 60 and the lower spring 26. Hence, if the lower core 34 is constructed in the same manner as the upper core 32, that is, unless the lower core 34 is provided with the annular protrusion 36, the valve body 18 cannot be displaced suitably to its fully closed position by supplying an exciting current $I_0$ to the lower coil 42. In view of this respect, the electromagnetically driven valve 10 is constructed such that the valve body 18 can be displaced to its fully closed position with a low electric power consumption.

In order to suitably displace the valve body 18 to its fully closed position, when the valve body 18 is located at the critical position E, it is necessary to generate an attracting force that exceeds spring forces generated by the upper spring 60 and the lower spring 26 (the spring forces that urge the valve body 18 toward its neutral position). As the curve A and the straight line C in FIG. 8 indicate, the electromagnetically driven valve 10 satisfies the aforementioned requirement. Hence, the electromagnetically driven valve 10 can suitably displace the valve body 18 to its fully closed position.

No matter how small the attracting force generated between the armature 30 and the upper core 32 may be before the valve body 18 of the electromagnetically driven valve 10 reaches the critical position E, if the aforementioned requirement is satisfied when the valve body 18 reaches the critical position E, the valve body 18 will be suitably displaced to its fully closed position. As illustrated in FIG. 8, if an exciting current $I_0$ is supplied to the upper coil 40, an attracting force generated between the armature 30 and the upper core 32 when the valve body 18 reaches the critical position E is sufficiently larger than the spring forces generated by the upper spring 60 and the lower spring 26. Thus, even if the exciting current supplied to the upper coil 40 is smaller than a predetermined value $I_0$, the electromagnetically driven valve 10 can suitably displace the valve body 18 to its fully closed position.

As the curve A and the curve B in FIG. 8 indicate, the upper core 32 is more suitable in structure than the lower core 34 to generate a close-state attracting force $F_N$ sufficiently large from the exciting current $I_0$. Thus, the upper core 32 is more suitable in structure than the lower core 34 to generate an attracting force exceeding the spring forces generated by the upper spring 60 and the lower spring 26 with a low electric power consumption when the valve body 18 is located at the critical position E. In this embodiment, the exciting current supplied to the upper coil 40 is set to such a value that the attracting force generated between the armature 30 and the upper core 32 when the valve body 18 is located at the critical position E slightly exceeds the spring forces generated by the upper spring 60 and the lower spring 26. As a result, the electromagnetically driven valve 10 makes it possible to drastically economize on electric power in displacing the valve body 18 to its fully closed position.

While the internal combustion engine is in operation, the valve body 18 needs to be held either at its fully closed position or at its fully open position. The electromagnetically driven valve 10 can hold the valve body 18 at either its fully closed position or its fully open position by supplying a suitable exciting current to the lower coil 42 or the upper coil 40 after arrival of the valve body 18 at its fully open or closed position—that is, after arrival of the armature 30 on the lower core 34 or the upper core 32.

As described previously, given an exciting current $I_0$, the abutment-state attracting force $F_C$ generated between the armature 30 and the upper core 32 is substantially equal to the abutment-state attracting force $F_C$ generated between the armature 30 and the lower core 34. Thus, the electromagnetically driven valve 10 makes it possible to drastically economize on electric power not only in displacing the valve body 18 to its fully closed position but also in displacing the valve body 18 to its fully open position.

As described previously, the characteristics of the electromagnetically driven valve 10 according to this embodiment are determined in view of the relationship between timings for opening and closing the valve body 18 and operating conditions of the internal combustion engine. Thus, while the internal combustion engine is in operation, the electromagnetically driven valve 10 can suitably open and close the valve body 18, while making it possible to drastically economize on electric power.

Figure 15:
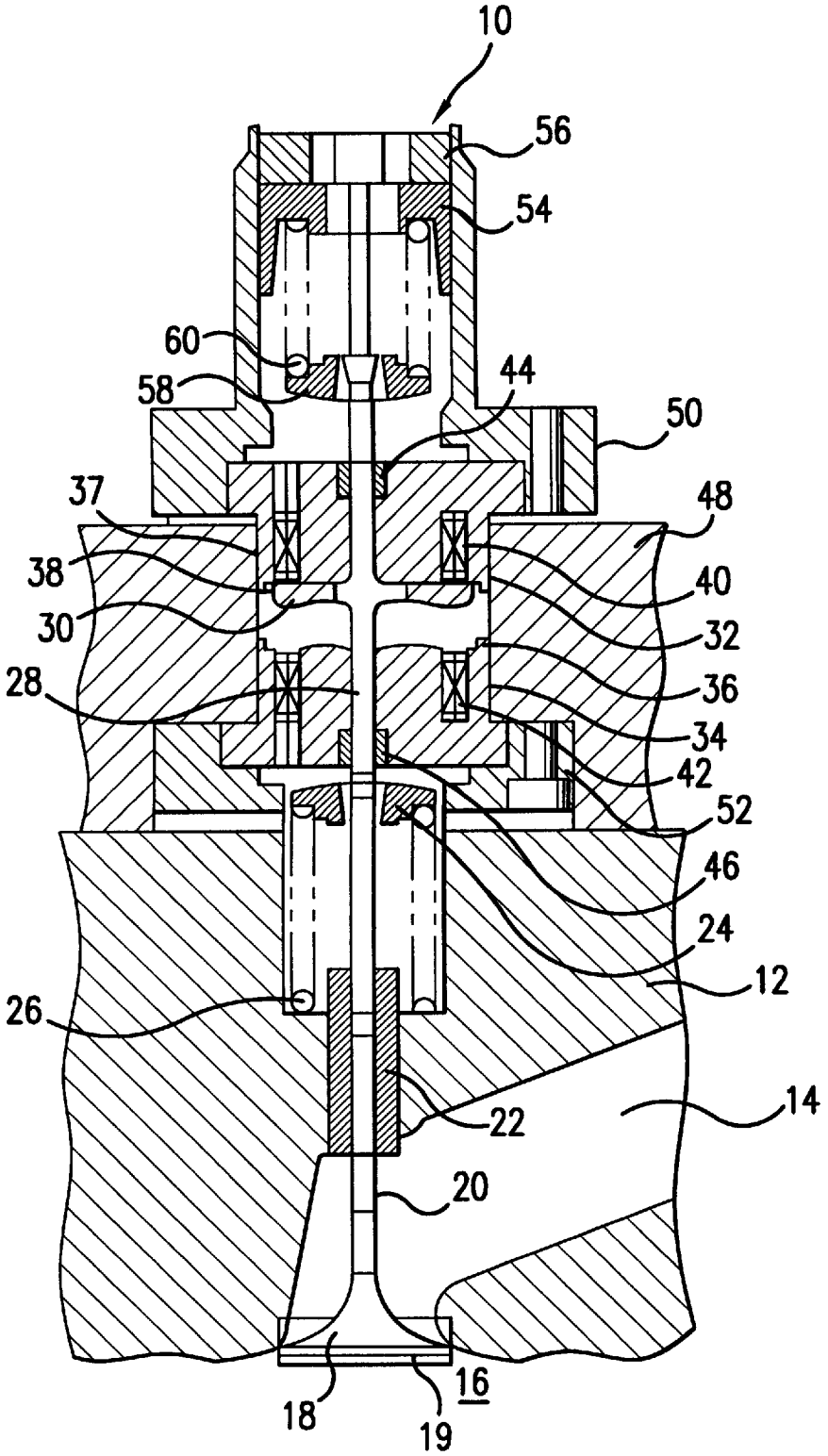
FIG. 15 is an overall structural view of an electromagnetically driven valve according to a further embodiment of the present invention.

Although the upper core 32 is not provided with a protrusion in this embodiment, the present invention is not limited to such a construction. For example, the upper core 32 may be provided with a protrusion that is smaller than the annular protrusion 36, as shown in FIG. 15.

An electromagnetically driven valve according to a second embodiment of the present invention will now be described with reference to FIG. 9.

Figure 9:
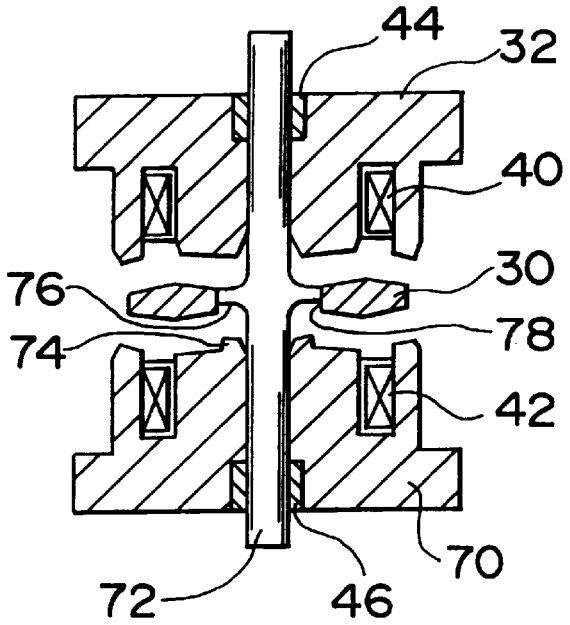
FIG. 9 is a sectional view illustrating a part surrounding an armature of an electromagnetically driven valve according to a second embodiment of the present invention.

FIG. 9 is a sectional view illustrating a part surrounding the armature of the electromagnetically driven valve according to the second embodiment. In FIGS. 9 and 1, like elements are denoted by like reference numerals. Referring to FIG. 9, the description of those elements constructed in the same manner as in FIG. 1 will be omitted.

The electromagnetically driven valve according to this embodiment is realized by substituting a lower core 70 and an armature shaft 72 as illustrated in FIG. 9 for the lower core 34 and the armature shaft 28 as illustrated in FIG. 1. The lower core 70 has an annular protrusion 74 surrounding the armature shaft 72. On the other hand, the armature shaft 72 has a recess 76 accommodating the annular protrusion 74. The armature shaft 72 is connected with the armature 30 at the recess 76.

By providing the armature shaft 72 with the recess 76, a protrusion facing side 78 is formed on an inner peripheral surface of the armature 30. When the armature 30 is close to the lower core 70, the protrusion facing side 78 of the armature 30 faces an outer peripheral surface of the annular protrusion 74. Since the inner diameter of the armature 30 is slightly larger than the outer diameter of the annular protrusion 74, a predetermined clearance is always formed between the protrusion facing side 78 and the annular protrusion 74.

In the electromagnetically driven valve according to this embodiment, the annular protrusion 74 and the protrusion facing side 78 operate substantially in the same manner as the annular protrusion 36 and the protrusion facing side 38. Thus, as is the case with the electromagnetically driven valve 10 according to the first embodiment, while the internal combustion engine is in operation, the electromagnetically driven valve according to this embodiment can suitably open and close the valve body 18, while making it possible to drastically economize on electric power.

An electromagnetically driven valve according to a third embodiment of the present invention will now be described with reference to FIG. 10.

Figure 10:
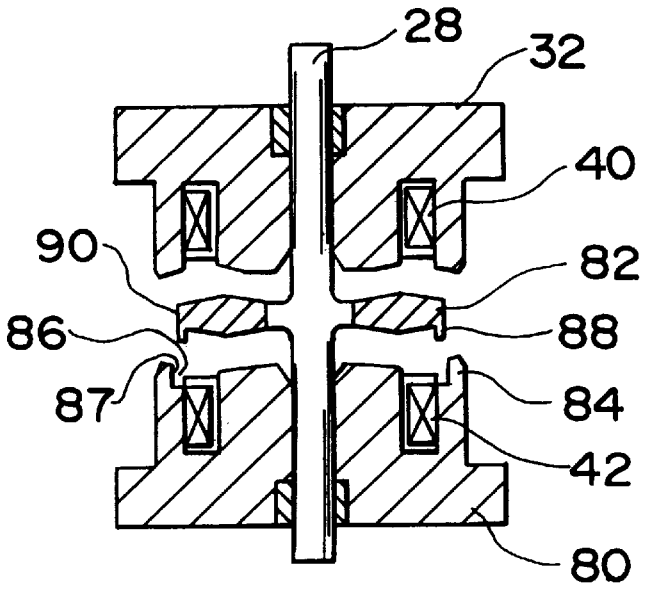
FIG. 10 is a sectional view illustrating a part surrounding an armature of an electromagnetically driven valve according to a third embodiment of the present invention.

FIG. 10 is a sectional view illustrating a part surrounding the armature of the electromagnetically driven valve according to the third embodiment. In FIGS. 10 and 1, like elements are denoted by like reference numerals. Referring to FIG. 10, the description of those elements constructed in the same manner as in FIG. 1 will be omitted.

The electromagnetically driven valve according to this embodiment is realized by substituting a lower core 80 and an armature 82 as illustrated in FIG. 10 for the lower core 34 and the armature 30 as illustrated in FIG. 1. The lower core 80 has a first annular protrusion 84 and an annular groove 86. The first annular protrusion 84 is disposed along the outermost periphery of the lower core 80 and the annular groove 86 is located radially inward of the first annular protrusion 84. A first protrusion facing side 87 is formed on an inner peripheral surface of the first annular protrusion 84. On the other hand, a second annular protrusion 88 is disposed along the outermost periphery of the armature 82. A second protrusion facing side 90 is formed on an outer peripheral surface of the second annular protrusion 88.

The second annular protrusion 88 is disposed so as to be fitted with the annular groove 86 of the lower core 80 when the armature 82 is close to the lower core 80. In this state, the second protrusion facing side 90 faces an inner wall of the first annular protrusion 84. That is, the outer peripheral surface of the second annular protrusion 88 faces the first protrusion facing side 87. Since the outer diameter of the armature 82 is slightly smaller than the outer diameter of the first annular protrusion 84, a predetermined clearance is always formed between the first annular protrusion 84 and the second protrusion facing side 90.

In the electromagnetically driven valve according to this embodiment, the first annular protrusion 84 and the second annular protrusion 88 operate substantially in the same manner as the annular protrusion 36 in the first embodiment. Further, the first protrusion facing side 87 and the second protrusion facing side 90 operate substantially in the same manner as the protrusion facing side 38 in the first embodiment. Thus, as is the case with the electromagnetically driven valve 10 according to the first embodiment, while the internal combustion engine is in operation, the electromagnetically driven valve according to this embodiment can suitably open and close the valve body 18, while making it possible to drastically economize on electric power.

Although the armature 82 is not provided with a protrusion protruding therefrom toward the upper core 32 in this embodiment, the present invention is not limited to such a construction. For example, a protrusion smaller than the second annular protrusion 88 may be formed on the side of the armature 82 that faces the upper core 32.

Although the lower core 80 and the armature 82 are provided with the first annular protrusion 84 and the second annular protrusion 88 respectively in this embodiment, the present invention is not limited to such a construction. It may also be possible to provide only the armature 82 with an annular protrusion.

An electromagnetically driven valve according to a fourth embodiment of the present invention will now be described with reference to FIG. 11.

Figure 11:
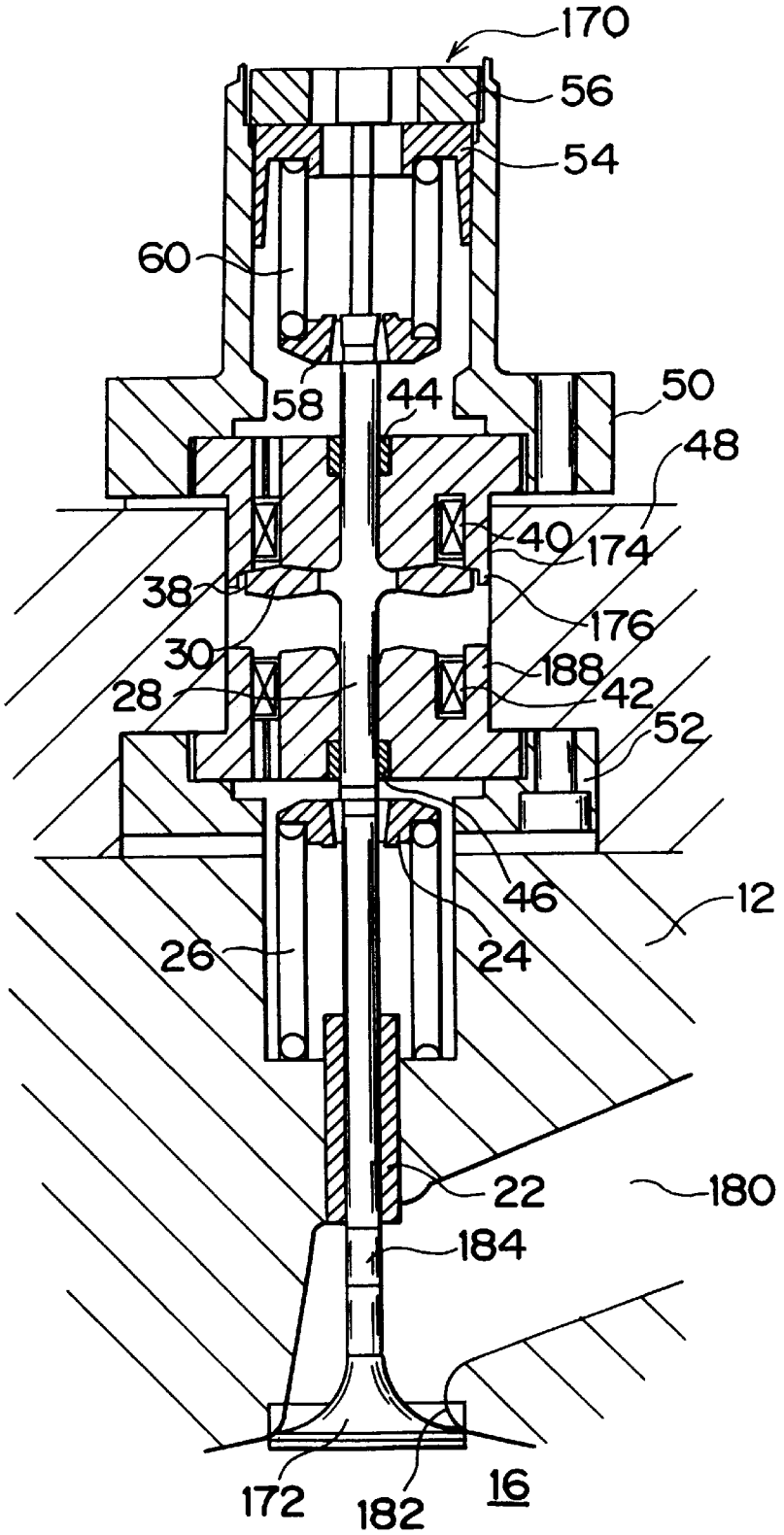
FIG. 11 is an overall structural view of an electromagnetically driven valve according to a fourth embodiment of the present invention.

FIG. 11 is an overall structural view of an electromagnetically driven valve 170 according to the fourth embodiment. The electromagnetically driven valve 170 is characterized in that it is provided with an intake valve 172 and an annular protrusion 176 is formed only on an upper core 174. In FIGS. 11 and 1, like elements are denoted by like reference numerals. Referring to FIG. 11, the description of those elements constructed in the same manner as in FIG. 1 will be omitted or simplified. Formed in the cylinder head 12 is an intake port 180 in which a valve seat 182 is disposed. When the intake valve 172 moves onto the valve seat 182, the intake port 180 is brought out of communication with the combustion chamber 16. When the intake valve 172 moves away from the valve seat 182, the intake port 180 is brought into communication with the combustion chamber 16.

Unlike the case of the exhaust valve, the intake valve 172 is opened when no combustion pressure remains in the combustion chamber 16. Thus, whether the intake valve 172 is driven to be opened or closed, there is no substantial change in an external force impeding the operation of the intake valve 172. As a result, the amount of amplitude damped by the external force remains substantially unchanged regardless of whether the intake valve 172 is driven to be opened or closed.

The electromagnetically driven valve 170 is constructed such that the intake valve 172 reliably moves onto the valve seat 182 without being adversely affected by thermal expansion of a valve shaft 184 and the like. That is, the electromagnetically driven valve 170 is constructed such that even if the valve shaft 184 and the like thermally expand, the intake valve 172 always reaches the valve seat 182 prior to arrival of the armature 30 on the upper core 174. Therefore, as the armature 30 is attracted toward the upper coil 40, the electromagnetically driven valve 170 may bring about circumstances where only the armature 30 and the armature shaft 28 are separated from the valve shaft 184 and move toward the upper coil 40 after arrival of the intake valve 172 on the valve seat 182.

In the electromagnetically driven valve 170, since the upper retainer 58 is attached to the armature shaft 28, the spring force of the upper spring 60 is directly transmitted to the armature shaft 28. On the other hand, since the lower retainer 24 is attached to the valve shaft 184, the spring force of the lower spring 26 is indirectly transmitted to the armature shaft 28 via the valve shaft 184.

As described above, the electromagnetically driven valve 170 brings about circumstances where the armature shaft 28 is separated from the valve shaft 184 after close approximation of the armature 30 to the upper coil 40. Under such circumstances, the spring force of the lower spring 26 is not transmitted to the armature shaft 28, to which only the spring force of the upper spring 60 is transmitted.

The upper spring 60 generates a spring force urging the armature 30 toward the lower coil 42. Hence, when only the spring force generated by the upper spring 60 acts on the armature shaft 28, the amplitude of the armature 30 moving toward the upper coil 40 is abruptly damped.

As the armature 30 moves toward the lower coil 42, both the spring force of the upper spring 60 and the spring force of the lower spring 26 constantly act on the armature shaft 28 until the armature 30 reaches the lower coil 42 after separation of the armature 30 from the upper coil 40. Hence, as the armature 30 moves toward the lower coil 42, the amplitude of the armature 30 is not abruptly damped.

As described hitherto, the electromagnetically driven valve 170 ensures that the spring forces of the upper spring 60 and the lower spring 26 damp the amplitude of the armature shaft 28 more drastically when the armature 30 moves toward the upper coil 40 than when the armature 30 moves toward the lower coil 42. Thus, the amplitude of the intake valve 172 tends to be damped more drastically during the valve closing operation than during the valve opening operation.

In the electromagnetically driven valve 170 according to this embodiment, the upper core 174 is provided with the annular protrusion 176 surrounding the armature 30. Thus, the attracting force generated between the armature 30 and the upper core 174 is relatively large when the intake valve 172 is located in the vicinity of its neutral position, so that the aforementioned difference in damping amount of amplitude can be eliminated. Accordingly, while the internal combustion engine is in operation, the electromagnetically driven valve 170 can suitably open and close the valve body, while making it possible to drastically economize on electric power.

Figure 12:
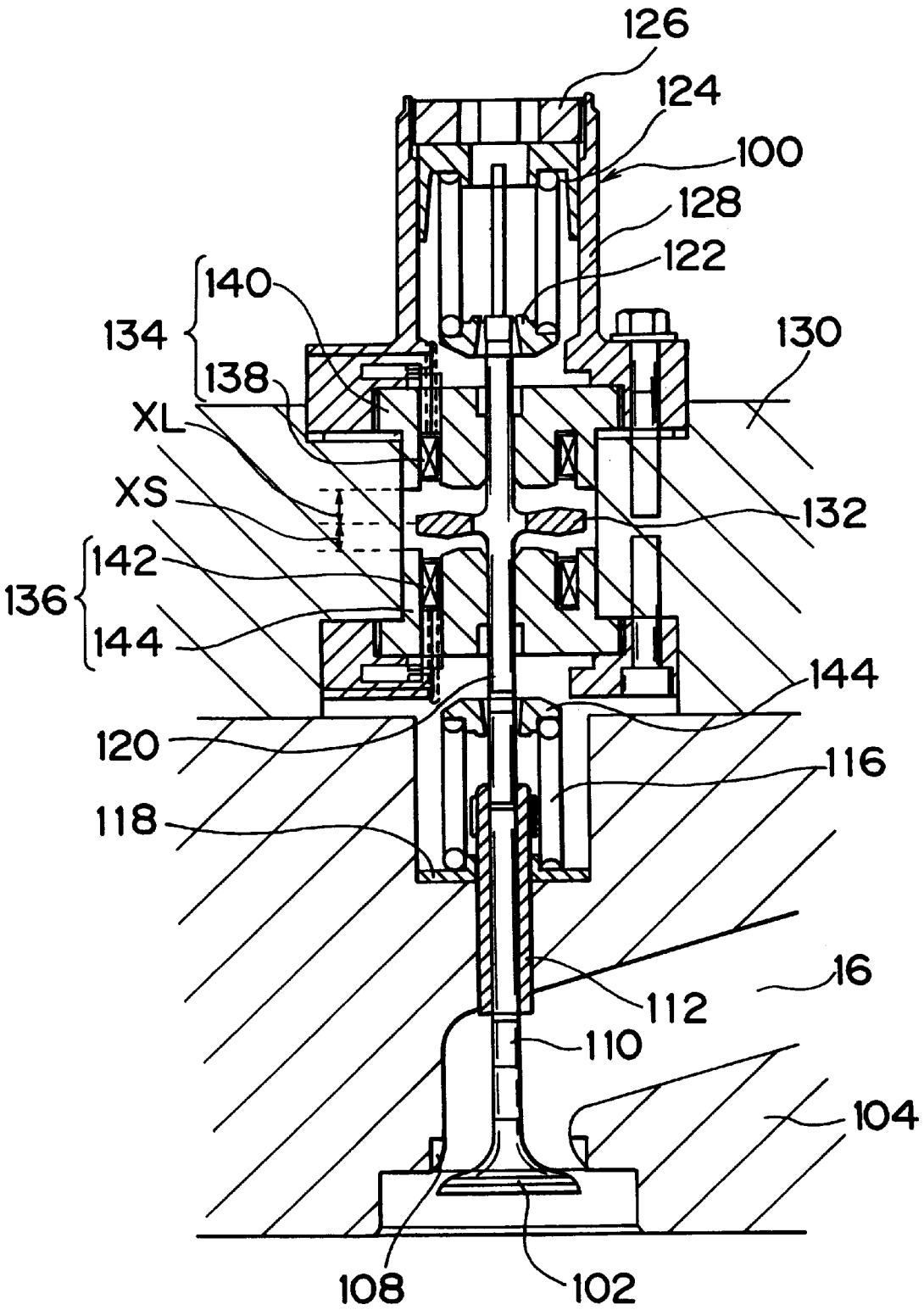
FIG. 12 is an overall structural view of an electromagnetically driven valve according to a fifth embodiment of the present invention.

FIG. 12 is an overall structural view of an electromagnetically driven valve 100 according to a fifth embodiment of the present invention. The electromagnetically driven valve 100 according to this embodiment is provided with an exhaust valve 102 for an internal combustion engine. The exhaust valve 102 is disposed in a cylinder head 104 such that the exhaust valve 102 is exposed to a combustion chamber in the internal combustion engine. Formed in the cylinder head 104 is an exhaust port 106 in which a valve seat 108 for the exhaust valve 102 is disposed. When the exhaust valve 102 moves away from the valve seat 108, the exhaust port 106 is brought into communication with the combustion chamber. When the exhaust valve 102 moves onto the valve seat 108, the exhaust port 106 is brought out of communication with the combustion chamber.

A valve shaft 110 is attached to the exhaust valve 102. The valve shaft 110 is axially slidably held by a valve guide 112 supported by the cylinder head 104. A lower retainer 114 is attached to an upper end portion of the valve shaft 110. A lower spring 116 and a spring seat 118 are disposed below the lower retainer 114. The lower spring 116 urges the lower retainer 114 upwards in FIG. 12.

An armature shaft 120 made of a non-magnetic material is disposed on the valve shaft 110. An upper retainer 122 is attached to an upper end portion of the armature shaft 120. An upper spring 124 is disposed on the upper retainer 122. The upper spring 124 urges the upper retainer 122 downwards in FIG. 12.

An upper end portion of the upper spring 124 is held by a spring holder 124 on which an adjuster bolt 126 is disposed. The adjuster bolt 126 is screwed into an upper cap 128 attached to a housing plate 130.

An armature 132, which is an annular member made of a magnetic material, is connected with the armature shaft 120. A first electromagnet 134 and a second electromagnet 136 are disposed above and below the armature 132 respectively. The first electromagnet 134 is provided with an upper coil 138 and an upper core 140, while the second electromagnet 136 is provided with a lower coil 142 and a lower core 144. The housing plate 130 maintains a predetermined relationship in relative location between the first electromagnet 134 and the second electromagnet 136.

In the electromagnetically driven valve 100, the armature 132 is urged toward its neutral position by the upper spring 124 urging the armature shaft 120 downwards and the lower spring 116 urging the valve shaft 112 upwards. The neutral position of the armature 132 can be adjusted by the adjuster bolt 126.

In this embodiment, the electromagnetically driven valve 100 is characterized in that the neutral position of the armature 132 is biased a predetermined distance toward the lower core 144 from the central position between the upper core 140 and the lower core 144. In the following description, the distance between the upper core 140 and the neutral position of the armature 132 will be denoted by XL and the distance between the lower core 144 and the neutral position of the armature 132 will be denoted by XS (<XL).

The operation of the electromagnetically driven valve 100 as well as the effect achieved by the aforementioned features will hereinafter be described.

In the electromagnetically driven valve 100, when no exciting current is supplied to the upper coil 138 and the lower coil 142, the armature 132 is held at its neutral position. In this state, the exhaust valve 102 is located between its fully open position and its fully closed position. If an exciting current is supplied to the upper coil 138 under such circumstances, an attracting force that attracts the armature 132 toward the first electromagnet 134 is generated between the first electromagnet 134 and the armature 132.

Thus, the electromagnetically driven valve 100 can displace the armature 132 toward the first electromagnet 134 by supplying a suitable exciting current to the upper coil 138. The armature shaft 120 can be displaced toward the first electromagnet 134 until the armature 132 collides with the upper core 140. The electromagnetically driven valve 100 is constructed such that the exhaust valve 102 reliably moves onto the valve seat 108 prior to arrival of the armature 132 on the upper core 140 without being adversely affected by thermal expansion of the valve shaft 110 and the like. Thus, the electromagnetically driven valve 100 can reliably displace the exhaust valve 102 to its fully closed position by supplying a suitable exciting current to the upper coil 138.

When the armature 132 is magnetically coupled to the first electromagnet 134, the upper spring 128 contracts in the axial direction by approximately a predetermined length XL and the lower spring 116 expands in the axial direction by approximately the predetermined length XL in comparison with a case where the armature 132 is held at its neutral position. In this state, provided that K represents a spring constant of the upper spring 128 and the lower spring 116, the amount of energy EU stored in the upper spring 128 and the lower spring 116 is expressed as follows.

$$EU=K\,XL^2/2 \quad (1)$$

When the armature 132 is magnetically coupled to the first electromagnet 134 and the supply of an exciting current to the upper coil 138 is stopped, the spring forces of the upper spring 124 and the lower spring 116 displace the armature shaft 120, the valve shaft 110 and the exhaust valve 102 so as to open the exhaust valve 102. Such displacement causes energy loss resulting from sliding friction or the like. Thus, the amplitude of the exhaust valve 102 is damped to a certain extent as the exhaust valve 102 is displaced toward its fully open position.

The electromagnetically driven valve 100 generates an electromagnetic force attracting the armature 132 toward the second electromagnet 136 between the second electromagnet 136 and the armature 132 by supplying an exciting current to the lower coil 142. Thus, the electromagnetically driven valve 100 can compensate for the aforementioned damping effect and displace the armature 132 to the second electromagnet 136 by supplying an exciting current to the lower coil 142 at a suitable timing after stoppage of supply of an exciting current to the upper coil 134.

The exhaust valve 102 is fully open when the armature 132 abuts against the second electromagnet 136. Accordingly, the electromagnetically driven valve 100 can displace the exhaust valve 102 from its fully closed position to its fully open position by the supply of an exciting current to the lower coil 142 begun at a suitable timing after stoppage of supply of an exciting current to the upper coil 138.

When the armature 132 is magnetically coupled to the second electromagnet 136, the upper spring 128 expands in the axial direction by approximately a predetermined length XS and the lower spring 116 contracts in the axial direction by approximately the predetermined length XS in comparison with a case where the armature 132 is held at its neutral position. In this state, provided that K represents the spring constant of the upper spring 128 and the lower spring 116, the amount of energy EL stored in the upper spring 128 and the lower spring 116 is expressed as follows.

$$EL=K\,XS^2/2 \quad (2)$$

When the armature 132 is magnetically coupled to the second electromagnet 136, if supply of an exciting current to the lower coil 142 is stopped, the spring forces of the upper spring 124 and the lower spring 116 displace the armature shaft 120, the valve shaft 110 and the exhaust valve 102 so as to close the exhaust valve 102. Such displacement causes energy loss resulting from sliding friction or the like. Thus, the amplitude of the exhaust valve 102 is damped to a certain extent as the exhaust valve 102 is displaced toward its fully closed position.

The electromagnetically driven valve 100 can compensate for the aforementioned damping effect and displace the armature 132 to the first electromagnet 134 by supplying an exciting current to the upper coil 138 at a suitable timing after stoppage of supply of an exciting current to the lower coil 142. Hence, the electromagnetically driven valve 100 can suitably open and close the exhaust valve 102 by alternately supplying an exciting current to the upper coil 124 and the lower coil 130.

In the internal combustion engine, the exhaust valve 102 is opened when a high combustion pressure remains in the combustion chamber. Therefore, the amplitude of the exhaust valve 102 is damped more drastically during the valve opening operation than during the valve closing operation. Accordingly, the achievement of substantially the same operating characteristics in opening and closing the exhaust valve 102 requires that the exhaust valve 102 be urged with more energy during the valve opening operation than during the valve closing operation.

As described previously, more energy is stored in the upper spring 124 and the lower spring 116 in the case where the armature 132 is magnetically coupled to the first electromagnet 134 than in the case where the armature 132 is magnetically coupled to the second electromagnet 136. Thus, the electromagnetically driven valve 100 is constructed such that the upper spring 124 and the lower spring 116 urge the exhaust valve 102 with more energy during the valve opening operation than during the valve closing operation.

Since the upper spring 124 and the lower spring 116 urge the exhaust valve 102 as described above, the difference between the amount of energy loss during the valve opening operation and the amount of energy loss during the valve closing operation can be eliminated by the energy generated by the upper spring 124 and the lower spring 116. Consequently, the electromagnetically driven valve 100 according to this embodiment can achieve substantially the same operating characteristics in opening and closing the exhaust valve 102 without substantially increasing a difference between the exciting current to be supplied to the upper coil 138 and the exciting current to be supplied to the lower coil 142.

Although the neutral position of the armature 132 is always biased toward the second electromagnet 136 in this embodiment, the present invention is not limited to such a construction. For example, an actuator capable of changing the neutral position of the armature 132 may be provided so as to shift the neutral position of the armature 132 toward the second electromagnet 136 only when a high combustion pressure builds up in the combustion chamber, namely, when a high load is applied to the internal combustion engine or when the internal combustion engine rotates at a high speed.

A sixth embodiment of the present invention will now be described with reference to FIG. 13.

Figure 13:
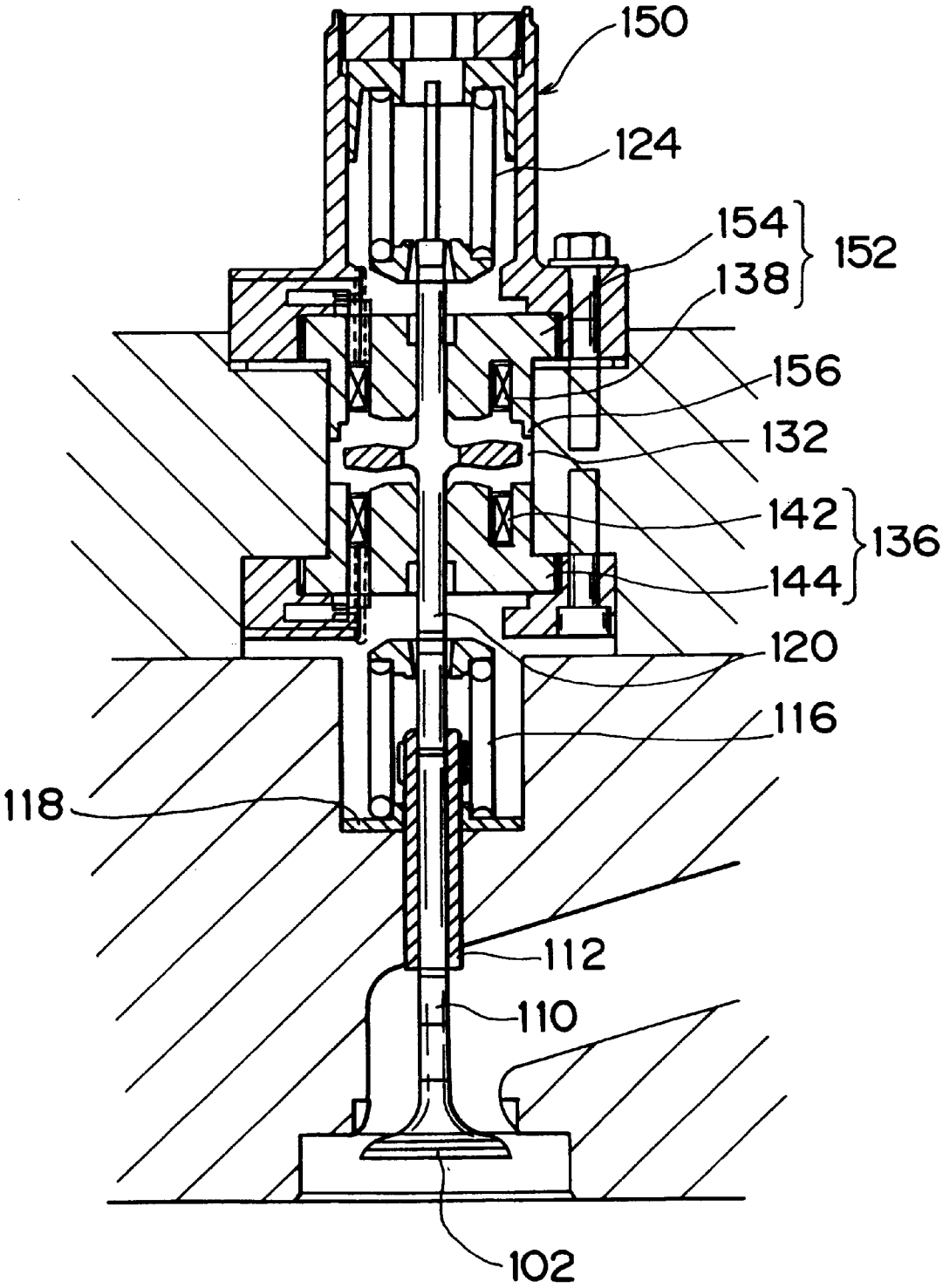
FIG. 13 is an overall structural view of an electromagnetically driven valve according to a sixth embodiment of the present invention.

FIG. 13 is an overall structural view of an electromagnetically driven valve 150 according to the sixth embodiment of the present invention. The electromagnetically driven valve 150 is provided with a first electromagnet 152 instead of the first electromagnet 134 in the electromagnetically driven valve 100 illustrated in FIG. 12. In FIGS. 13 and 12, like elements are denoted by like reference numerals. Referring to FIG. 13, the description of those elements constructed in the same manner as in FIG. 12 will be omitted or simplified.

The first electromagnet 152 has an upper core 154 accommodating the upper coil 138. An annular protrusion 156 is formed on an end face of the upper core 154 that faces the armature 132. The inner diameter of the annular protrusion 156 is slightly larger than the outer diameter of the armature 132. Thus, when the armature 132 is adsorbed on the first electromagnet 152, a predetermined air gap is formed between the armature 132 and the annular protrusion 156.

In this embodiment, the neutral position of the armature 132 is biased toward the second electromagnet 136 from the central position between the first electromagnet 152 and the second electromagnet 136 by a predetermined distance, as is the case with the fifth embodiment. This construction is advantageous in bringing the exhaust valve 102 close to the second electromagnet 136 by means of the spring forces of the upper spring 124 and the lower spring 116 during the valve opening operation.

In such a construction, however, the armature 132 tends to be spaced further apart from the first electromagnet 152 than in the construction in which the neutral position of the armature 132 is set to the central position between the first electromagnet 152 and the second electromagnet 136. The closer the armature 132 comes to the electromagnet, the more efficiently an electromagnetic force is generated between the armature 132 and the electromagnet. Therefore, it is not always favorable to bias the neutral position of the armature 132 toward the second electromagnet 136 in the light of the efficiency in generating an electromagnetic force between the armature 132 and the first electromagnet 152.

As described previously, the electromagnetically driven valve 150 according to this embodiment has a construction in which the annular protrusion 156 is formed on the upper core 154. Due to the annular protrusion 156, the distance between the end face of the upper core 154 and the armature 132 has been reduced. Hence, the first electromagnet 152 efficiently generates an electromagnetic force attracting the armature 132 when the neutral position of the armature 132 is biased toward the second electromagnet 136. Consequently, the electromagnetically driven valve 150 according to this embodiment makes it possible to further economize on electric power in comparison with the electromagnetically driven valve 100 according to the fifth embodiment.

A seventh embodiment of the present invention will now be described with reference to FIG. 14.

Figure 14:
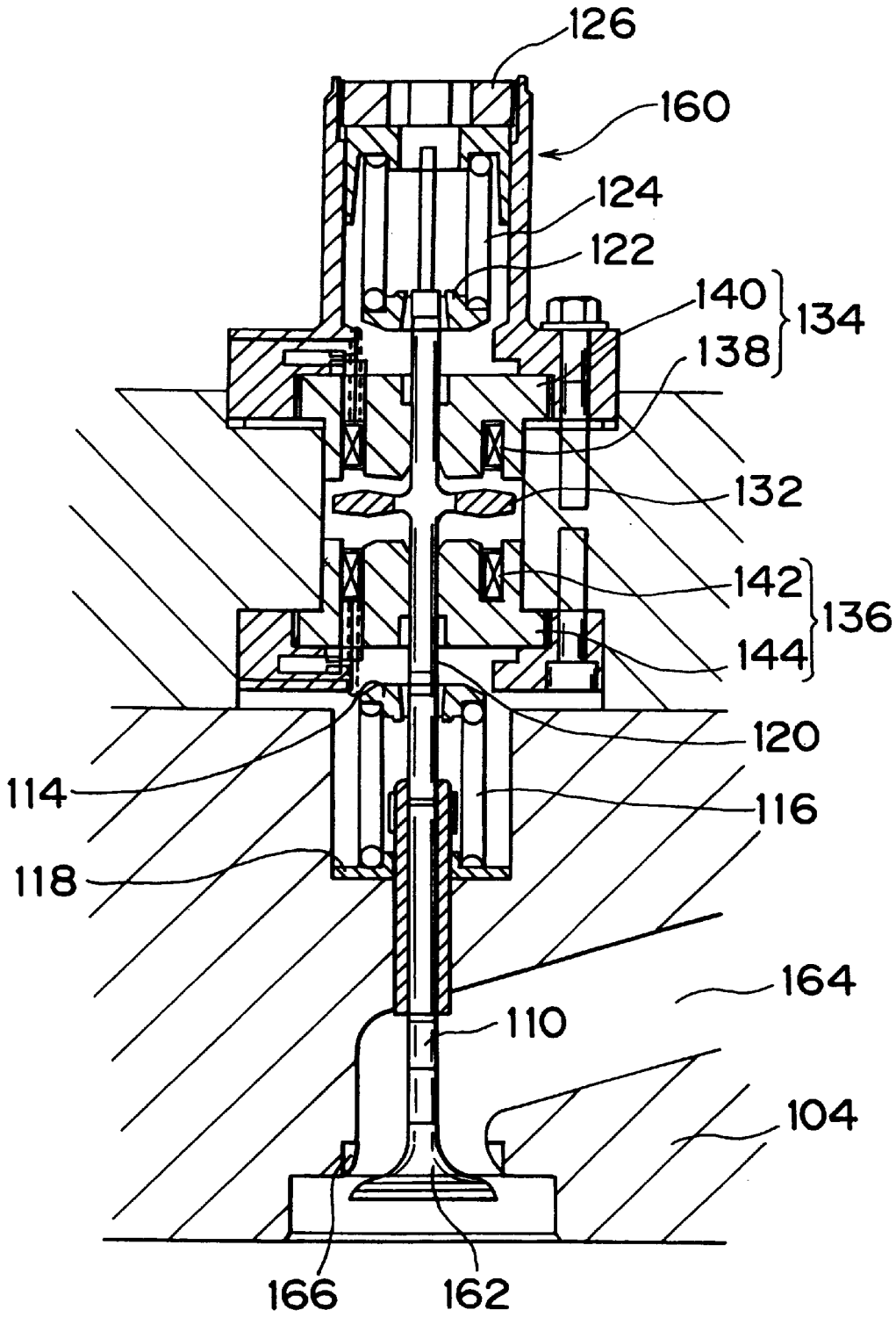
FIG. 14 is an overall structural view of an electromagnetically driven valve according to a seventh embodiment of the present invention.

FIG. 14 is an overall structural view of an electromagnetically driven valve 160 according to the seventh embodiment. The electromagnetically driven valve 160 is provided with an intake valve 162 and the neutral position of the armature 132 is biased by a predetermined distance toward the first electromagnet 134 from the center point between the first electromagnet 134 and the second electromagnet 136. In FIGS. 14 and 12, like elements are denoted by like reference numerals. Referring to FIG. 14, the description of those elements constructed in the same manner as in FIG. 12 will be omitted or simplified.

Formed in the cylinder head 104 is an intake port 164 in which a valve seat 166 is disposed. When the intake valve 162 moves onto the valve seat 166, the intake port 164 is brought out of communication with the combustion chamber. When the intake valve 162 moves away from the valve seat 166, the intake port 164 is brought into communication with the combustion chamber.

Unlike the case of the exhaust valve 102, the intake valve 162 is opened when no combustion pressure remains in the combustion chamber. Hence, whether the intake valve 162 is driven to be opened or closed, there is no substantial change in an external force impeding the operation of the intake valve 162. Thus, the amount of amplitude damped by the external force remains substantially unchanged regardless of whether the intake valve 162 is driven to be opened or closed.

The electromagnetically driven valve 160 is constructed such that the intake valve 162 reliably moves onto the valve seat 166 without being adversely affected by thermal expansion of the valve shaft 110 and the like. In other words, the electromagnetically driven valve 160 is constructed such that even if the valve shaft 110 and the like thermally expand, the intake valve 162 always reaches the valve seat 166 prior to arrival of the armature 132 on the upper core 140. Hence, as the armature 132 is attracted toward the first electromagnet 134, the electromagnetically driven valve 160 may bring about circumstances where only the armature 132 and the armature shaft 120 are separated from the valve shaft 110 and move toward the first electromagnet 134 after arrival of the intake valve 162 on the valve seat 166.

In the electromagnetically driven valve 160, since the upper retainer 122 is attached to the armature shaft 120, the spring force of the upper spring 124 is directly transmitted to the armature shaft 120. On the other hand, since the lower retainer 114 is attached to the valve shaft 110, the spring force of the lower spring 116 is indirectly transmitted to the armature shaft 120 via the valve shaft 110.

As described above, the electromagnetically driven valve 160 brings about circumstances where the armature shaft 120 is separated from the valve shaft 110 after close approximation of the armature 132 to the first electromagnet 134. Under such circumstances, the spring force of the lower spring 116 is not transmitted to the armature shaft 120, to which only the spring force of the upper spring 124 is transmitted.

The upper spring 124 generates a spring force urging the armature 132 toward the second electromagnet 136. Hence, when only the spring force generated by the upper spring 124 acts on the armature shaft 120, the amplitude of the armature 132 moving toward the first electromagnet 134 is abruptly damped.

As the armature 132 moves toward the second electromagnet 136, both the spring force of the upper spring 124 and the spring force of the lower spring 116 act on the armature shaft 120 until the armature 132 reaches the second electromagnet 136 after separation of the armature 132 from the first electromagnet 134 and abutment of the valve shaft 110 on the armature shaft 120. Hence, as the armature 132 moves toward the second electromagnet 136, the amplitude of the armature 132 is not abruptly damped.

As described hitherto, the electromagnetically driven valve 160 is constructed such that the spring forces of the upper spring 124 and the lower spring 116 damp the amplitude of the armature shaft 120 more drastically when the armature 132 moves toward the first electromagnet 134 than when the armature 132 moves toward the second electromagnet 136. Thus, the amplitude of the intake valve 162 tends to be damped more drastically during the valve closing operation than during the valve opening operation.

As described above, the electromagnetically driven valve 160 has a construction in which the neutral position of the armature 132 is biased toward the first electromagnet 134. In this construction, the upper spring 124 and the lower spring 116 urge the armature shaft 120 with more energy during the valve closing operation of the intake valve 162 than during the valve opening operation of the intake valve 162. In this case, the difference between the amount of amplitude damped during the valve opening operation and the amount of amplitude damped during the valve closing operation can be eliminated by the energy generated by the upper spring 124 and the lower spring 116. Therefore, the electromagnetically driven valve 160 according to this embodiment can achieve substantially the same operating characteristics in opening and closing the intake valve 162 without substantially increasing a difference between the exciting current to be supplied to the upper coil 138 and the exciting current to be supplied to the lower coil 142.

The neutral position of the armature 132 in the electromagnetically driven valve 160 according to this embodiment is different from the neutral position of the armature in the fifth and sixth embodiments. This kind of structural difference can be achieved, for instance, by adjusting the degree to which the adjuster bolt 126 is screwed into the upper cap or by changing the thickness of the spring seat 118. By changing the thickness of the spring seat 118, the upper spring 124 and the lower spring 116 can commonly be employed both in the electromagnetically driven valves 100, 150 for driving the exhaust valve 102 and in the electromagnetically driven valve 160 for driving the intake valve 162.

While the present invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. An electromagnetically driven valve for an internal combustion engine, comprising:

an armature coupled to a valve body of an exhaust valve of the engine for reciprocal movement therewith between an open position and a closed position;

a first elastic member coupled to the armature to bias the armature toward the open position and a second elastic member coupled to the armature to bias the armature toward the closed position, wherein a neutral position of the armature is defined between the open and closed positions at a point where forces applied by the first and second elastic members balance one another; and a first core including a first coil therein and a second core including a second coil therein, wherein the first and second cores are disposed on opposite sides of the armature and are positioned so that, when the armature is in the neutral position, the first and second cores are spaced apart from the armature and wherein the first coil generates an electromagnetic force to attract the armature toward the open position;

wherein one of the first core and the armature is provided with a first protrusion protruding a predetermined length toward the other of the first core and the armature thereby making a distance between the first core and the armature smaller than a distance between the second core and the armature when the armature is located in the neutral position and wherein the other of the first core and the armature is provided with a protrusion facing side that faces a side of the first protrusion which extends substantially parallel to the direction of armature movement when said armature is in the open position.

2. The electromagnetically driven valve according to claim 1, wherein the second core is provided with a second protrusion that is smaller than the first protrusion.

3. The electromagnetically driven valve according to claim 1, wherein the first protrusion extends from the first core.

4. The electromagnetically driven valve according to claim 3, wherein the first protrusion is annular and has a diameter slightly larger than an outer diameter of the armature.

* * * * *